United States Patent [19]

Reim

[11] 4,212,122

[45] Jul. 15, 1980

[54] FRAMING MEANS FOR FRAMING A PICTURE OR OTHER OBJECT

[76] Inventor: Paul Reim, Rathausgasse 5, D-7100 Heilbronn, Fed. Rep. of Germany

[21] Appl. No.: 878,742

[22] Filed: Feb. 17, 1978

[30] Foreign Application Priority Data

Feb. 25, 1977 [DE] Fed. Rep. of Germany ..... 2708144

[51] Int. Cl.[2] ..... G09F 1/12

[52] U.S. Cl. ..... 40/152.1; 248/460

[58] Field of Search ..... 40/156, 152, 154, 152.1; 248/460

[56] References Cited

U.S. PATENT DOCUMENTS

| | | | |
|---|---|---|---|
| 2,758,402 | 8/1956 | Fulmer | 40/152.1 |
| 2,881,544 | 4/1959 | Knox | 40/156 |
| 3,430,829 | 3/1969 | Wilson et al. | 40/1.5 |
| 3,611,604 | 10/1971 | Saltzman | 40/152 |
| 3,711,978 | 1/1973 | Conrad | 40/152 |
| 3,924,307 | 12/1975 | Tate | 40/156 X |
| 3,965,599 | 6/1956 | Ebner | 40/152 |

FOREIGN PATENT DOCUMENTS

| | | | |
|---|---|---|---|
| 1201649 | 7/1959 | France | 40/152 |
| 280416 | 4/1952 | Switzerland | 40/152 |

*Primary Examiner*—Louis G. Mancene
*Assistant Examiner*—Wenceslao J. Contreras
*Attorney, Agent, or Firm*—Michael J. Striker

[57] ABSTRACT

Framing means for pictures and like objects includes a frame having a substantially L-shaped cross-section to define a front flange for supporting a picture holding set assembled of a transparent plate, a picture or the like object, resilient insert and a relatively rigid back board; the rear face of the frame is formed with juxtaposed pairs of inwardly directed, V-shaped projections which are spaced at such a distance from each other and from said front flange as to receive and hold in a fixed position said picture holding set while said resilient insert is in compressed state.

7 Claims, 5 Drawing Figures

FRAMING MEANS FOR FRAMING A PICTURE OR OTHER OBJECT

BACKGROUND OF THE INVENTION

This invention relates to framing means for framing a picture or like object, and is an improvement in or modification of the invention described in my patent application Ser. No. 651,468 entitled "Frame for Pictures and Like Objects" filed Jan. 22, 1976, now allowed.

The frame disclosed in the above application includes a resilient insert of a compressible elastic material disposed between the picture, supported on a rigid transparent plate, and a relatively rigid back board or rear plate.

The frame assembly of this kind, with the frame parts each engaging over the picture and a transparent plate in front thereof and each provided at a rear side thereof with a limb extending behind the backboard or rear plate, wherein the rear plate and the limbs of the frame parts possess interengaging connecting means, has proved successful both in manufacture and in use. This applies especially to medium and large picture frame sizes. The individual picture frame parts are in that case cut to length, with mitring, from extruded profiled members. The assembly and the disassembly of these frame parts with a glass plate, a picture, biasing insert in the form of an elastically compressible inlay, and the back board or rear plate can be accomplished quickly and without difficulty. The elastically compressible insert has proved to be a special advantage of these frames, as it effects a holding together of the frame by its spring action, provides a dustproof seal, increases stability and smoothes the inserted picture. In mass production of these frames, however, it has turned out to be unsatisfactory in the respect that nearly the same production times are required for manufacture of smaller picture frame sizes as for larger picture frame sizes.

Also the handling of these frames is to a large extent simple and problem-free, it is nevertheless still desirable to further simplify manufacture of smaller picture frame sizes and to provide for the possibility of pushing in of a picture frame prop or stand. It has also turned out to be a deficiency of these frames that only square and other rectangular formats can be produced.

There are also known picture frames in which a back board or rear plate, picture and glass plate are pressed, by means of beads, detent edges or detent locks, in this order into the frame from the front side thereof. A disadvantage of these frames is that, in handling, the glass plate is easily broken. A further disadvantage is that although they are suited for providing a frameless effect, they are unsuitable for the provision of ornamental surrounds. An advantage of these frames is that the glass plate cannot, through pressure on its front side, unintentionally fall rearwardly out of the frame with the other inserted items, such as the picture and back board.

In addition, there are known picture frames in which a transparent plate, picture and back board are laid in their surround from the rear side thereof. As a rule they are latched at the rear side by springs, bars, holding plates, studs, and so on. The disadvantage of these frames resides in their awkward handling, besides which the holding parts are not aesthetic.

Apart from these frames, there are also known frames in which a glass plate, picture and back board are laid into the frame from the rear side. With these frames, the back board is simply pressed into the surrounding frame and clamped thereby. These frames have inwardly directed clamping beads, clamping pins, clamping prongs, or cams as profiled limbs thereof. The handling of these frames, which are generally made of synthetic material, is usually quite simple as no retaining parts are needed. The disadvantage of these frames however is that to change the picture the inserted items must, through corresponding pressure on the front side of the transparent plate, be pressed rearwardly out of the frame. As a result, with these picture frames there is the risk that through any pressure, as is for example unavoidable in cleaning of the front plate, the inserted items including the plate unintentionally fall out of the frame which, apart from the inconvenience, usually result in breakage of the plate.

SUMMARY OF THE INVENTION

It is therefore an object of this invention to provide framing means which maintain the advantages of known picture frames and avoid their aforementioned disadvantages.

More specifically, it is an object of this invention to provide picture framing means which even in the range of smaller frame sizes have a reduced manufacturing cost and which are more convenient in use.

Another object of this invention is to provide framing means which have the facility to include a prop or picture stand which can be easily installed or removed.

Still another object of this invention is to provide picture framing means which can be easily manufactured both in quadrangular or polygonal shape as well as in an oval or circular shape.

Still another object of this invention is to provide picture framing means in which the picture or other object to be displayed, the biasing insert together with the backing plate and the transparent plate can be easily introduced into the surrounding frame and easily removed therefrom only from the rear side of the frame. The inserted picture holding set, such as the transparent plate, picture and so on, cannot, through intentional or unintentional pressure on the front side of the transparent plate, fall backwardly out of the frame and thereby be damaged.

According to this invention, the above objects are attained by providing framing means which include a frame having substantially L-shaped cross-section to define an inwardly projecting front flange; a picture holding set or assembly including a transparent front plate, a picture or object to be displayed, a cushion inlay or insert of a highly elastic material, and a back board or rear plate; and a plurality of arresting and retaining projections which are integrally formed on the rear edge of the frame and which extend inwardly at such a distance from each other and from said front flange as to receive and retain in a fixed position the picture holding set or assembly while said elastic cushion or insert in said picture holding assembly is in a compressed state.

Preferably, the arresting and retaining projections are arranged in juxtaposed pairs and have a V-shaped configuration and comprise a recess and an indented edge in this apex portion for enabling insertion of a support prop for the frame, the prop being insertable in a folded-out position or in a collapsed rest position.

The advantages of the solution according to this invention reside in the fact that while the construction according to the aforementioned U.S. patent application Ser. No. 651,468 has proved successful in the domain of medium and large size quadrangular frames, with individual production of all sizes including the smaller sizes, a framing means manufactured in accordance with this invention bring about a substantial reduction in working time for mass production of smaller frame sizes, as the frame can be manufactured by an injection molding process for example in a single short working step irrespective of the particular shape and configuration of the frame. Moreover, a cheaper kind of synthetic material may be used. A further advantage results from the fact that connecting means for the frame are not required on the rear plate.

The handling of the framing means of this invention is thus simplified insofar as the glass plate or the transparent plate, the picture, the elastic compressible insert as well as the back board or rear plate are pressed into the surrounding frame only from the rear side and can be easily removed therefrom. There is no possibility of an accidental falling out of the inserted flat items caused through intentional or unintentional pressure on the front side of the transparent plate and, therefore, these items cannot be accidentally damaged.

The arresting and retaining projections can be used for various purposes and obviate the separate indenting of a recess as a hanging means for the frame and additionally they take over holding in the frame of the picture holding set or assembly, that is of the transparent plate, the biasing insert, the picture or other object to be displayed, and the rear plate. The arresting and retaining projections may comprise a recess enabling insertion of a support prop for the frame, the prop being adjustable in the recess to take a folded working position or a collapsed rest position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
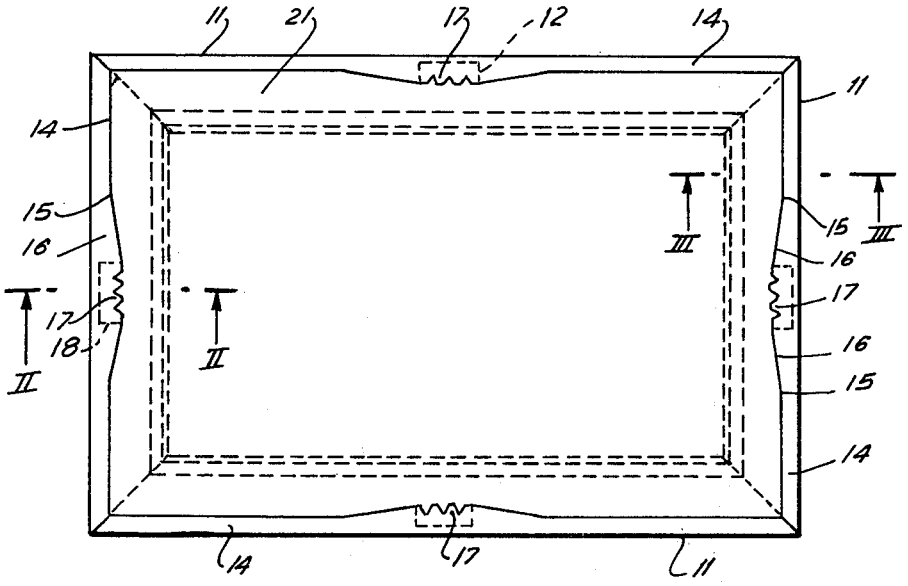
FIG. 1 is a schematic rear view of one embodiment of the picture framing means of this invention.
Figure 2:
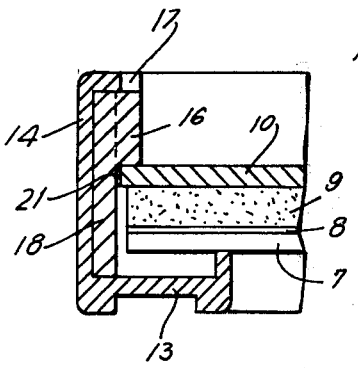
FIG. 2 is a cross-sectional view, taken on an enlarged scale and on the line A—A of FIG. 1, of the frame of this invention with arresting and retaining projections for engaging the rear plate.
Figure 3:
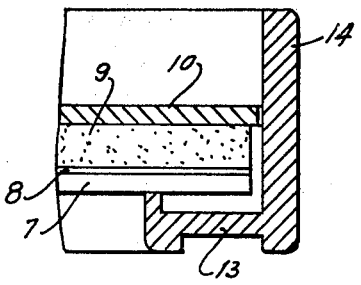
FIG. 3 is a cross-section, to an enlarged scale and on the line B—B of FIG. 1, of the part of the frame without the arresting and retaining projections.
Figure 4:
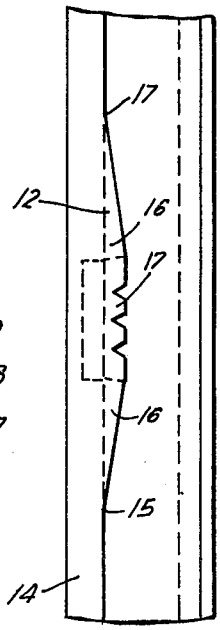
FIG. 4 is a rear view, to an enlarged scale of part of the frame showing an arresting and retaining projections thereof.

Referring now to FIGS. 1–3, there is shown framing means for framing a picture 8, the framing means including a frame 11 having a substantially L-shaped cross-section (FIG. 2 and FIG. 3), to define a closed wall which in this case is assembled of four profiled limbs 14 defining an inwardly directed front flange 13. The picture holding assembly includes a transparent plate 7 consisting of glass or synthetic material and arranged in the frame adjacent the front flange 13 thereof, with a picture 8 laid against the rear side of the plate 7. An elastically compressible insert 9 bears against the entire rear surface of the picture 8, and a substantially stiff rear plate 10 consisting of any suitable material such as cardboard, for example, is brought in contact with the resilient insert 9 and keeps the compressed resilient insert 9 in its place. The picture holding set or assembly is surrounded by a frame 11. The frame 11 is provided at the inwardly facing side of each of four side limbs 14 thereof with a respective multipurpose projection 12, each of the projections 12 being integrally connected with the respective limb 14. In the case of smaller sizes of frame 11, it is sufficient to provide four such projections 12, arranged in pairs opposite to each other. In the case of the larger size frame, however, it is possible to shape the frame with an arbitrary amount of such inwardly directed projections 12. The arresting and retaining projections 12 perform three functions and preferably each of the projections 12 comprises two wedge members 16 provided with, respectively, two ramp surfaces inclined inwardly of the frame, from points 15, in direction towards each other. The wedge members 16 which are spaced from the front flange 13 at such a distance as to accommodate the picture holding set 7, 8, 9, and 10 while the resilient insert 9 is in compressed condition, enable the projections 12 to carry out a first function, namely the insertion into the frame 11, firm retention therein, and subsequent easy release from the frame of the relatively stiff back board 10 which is slightly increased in size with respect to the remaining items of the picture holding set.

Figure 5:
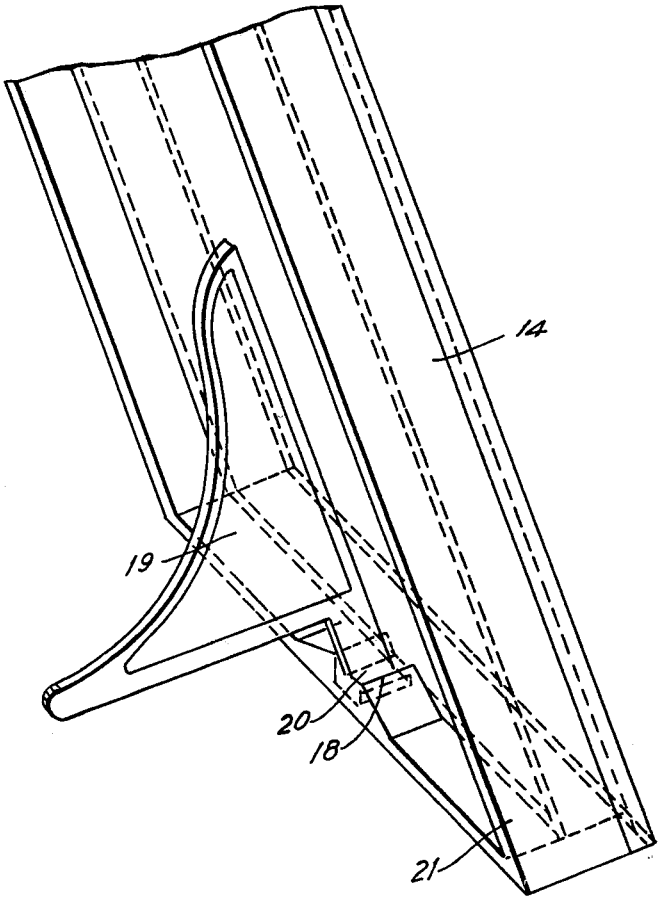
FIG. 5 is an oblique perspective view of the rear part of the framing means of this invention, showing a support prop engaged in a recess in an arresting and retaining projection thereof.

Another function of the projections 12 is possible by virtue of a toothed or indented connection part 17 extending between the wedge members 16 of each projection 12. Wall hooks or suspension studs are engageable in the indentation or the toothing of the connection part 17 which extends at the apex portion of the V-shaped projection 12. In this manner it is possible to hang the entire frame means on a wall, to which purpose a recess 18 in each limb 14 is provided, the recess being disposed behind each part 17 and between the members 16. Finally, the recess 18 also makes possible the connection of a support prop 19 (FIG. 5), which can be attached to the framing means in a protruding operative position or in a folded or collapsed rest position; the recess 18 is so dimensioned that a projecting portion 20 of the prop 19 can be inserted therein and can be rotated during the folding operation. The depth of the recess 18 is such that the nose of the projecting portion 20 of the prop 19 can be notched in behind the edge portion of the back board 21. The prop 19 is securely held in any desired position by means of the spring force generated by the elastically compressed insert 9 and acting on the rear plate or back board 10. Through lightly pressing against the back board 10 at it edge portion 21 beside the prop 19, the prop can be easily removed.

The assembly of the framing means according to this invention takes place as follows:

The transparent plate 7, the picture 8, and the elastically compressible inlet 9, in this order, are first laid against the flange 13 of the frame 11. The size of each of these three items is slightly smaller than the clear or interior dimension of the frame 11, so that they easily slide past the protruding wedge member 16 of the multipurpose projections 12. Finally, the rear plate or back board 10, the size of which substantially corresponds to the interior dimension of the frame 11, is pushed under the protruding wedge member 16 at one side of the frame. From this side, the back board 10 is then pressed in the direction towards the opposite side of the frame and is notched in. In this operation, the back board 10 is pressed from the point 15 past the member 16 onto the opposite one of the projections 12 and is notched in. At the opposite projection 12, the back board 10 slides from above past the member 16 without difficulty, as its effective length in the plane of the frame is shortened by its inclination during the pushing-in process. In pressing the back board 10 past the member 16 of the projections 12, stress arises, which causes the back board to be arched. The arching of the back board 10 effects a diminishing of its surface area, especially in the final phase of the pressing in, and the resilient insert 9 promotes this operation through its elastic yielding. The stress arising in the pressing in also causes the members 16, while the back board 10 is being pressed past them, to lightly stress the limb 14 outwards. Through the arching of the back board 10 and the yielding of the limb, the notching of the back board 10 under the members 16 is facilitated without the back board 10 or the frame 11 with its multipurpose projecting parts 12 being damaged. After the notching in of the back board 10, the limbs 14 and back board return to their normal positions. It will be noted that the frame 11 is constructed of a material which is relatively stiff but to a certain limited degree, is resiliently flexible.

The back board 10 cannot be pressed rearwardly out of the frame 11 through pressure on the front side of the transparent plate 7, since such pressure is distributed by the resilient inlet 9 over the entire surface of the rear plate or back board 10, whereby the back board 10 remains securely notched in under the members 16.

The removal of the transparent plate 7, picture 8, insert 9 and back board 10, takes place in the reverse order. First, the back board 10 must be removed. For this purpose, a recess 22 is provided in the back board at a spacing from the projection 12. Since the elastically compressible insert 9 is present behind the back board 10, it is possible to insert a finger into the recess and thereby draw the back board out of the frame 11, the back board being drawn in this operation without difficulty from the points 15 over the wedge member 16. The remaining items, that is the insert 9, picture 8, and plate 7 can then be taken out of the frame 11.

It is irrelevant whether the frame is of angular, round or oval shape since this invention enables to produce in the same manner any desired configuration of the framing means. With these frames, mirrors or stiff-backed pictures without transparent plates can also be inserted without difficulty.

While this invention has been described by way of a specific example, it is not intended to be limited to the exact details shown, since various modifications and structural changes can be made by persons skilled in the art without departing from the spirit of this invention.

What is claimed as new and desired to be protected by Letters Patent is set forth in the appended claims:

1. Framing means for pictures and like objects, including a frame having a substantially Lshaped cross-section to define an enclosure having an inwardly projecting front flange, a picture holding set including a transparent front plate for supporting a picture, an elastically compressible insert, and a rear plate, comprising a plurality of arresting and holding projections integrally formed on the rear edge of said frame and extending inwardly at such a distance from each other and from said front flange as to receive and hold in a fixed position said picture holding set while said elastically compressible insert is in compressed state , said projections having a substantially V-shaped configuration with inwardly projecting apexes, and the inner side of the apex portion of each projection being provided with a recess adapted for receiving a matching part of a detachable prop and the edge side between said recess and the outer side of said apex portion having indentations for accommodating suspension elements.

2. Framing means as claimed in claim 1, wherein said arresting and retaining projections are arranged in juxtaposed pairs.

3. Framing means as claimed in claim 1, wherein said frame together with said arresting and retaining projections is made as a single piece of plastic material.

4. Framing means as claimed in claim 1, wherein said frame has a substantially rectangular configuration.

5. Framing means as claimed in claim 1, wherein said frame has a round configuration.

6. Framing means as claimed in claim 1, wherein an edge of the rear plate is provided with a recess to facilitate the removal of said rear plate from said frame.

7. Framing means for pictures and like objects, including a frame having a substantially L-shaped cross-section to define an enclosure having an inwardly projecting front flange, a picture holding set including a transparent front plate for supporting a picture, an elastically compressible insert, and a rear plate, comprising a plurality of arresting and holding projections integrally formed on the rear edge of said frame and extending inwardly at such a distance from each other and from said front flange as to receive and hold in a fixed position said picture holding set while said elastically compressible insert is in compressed state, said arresting and retaining projections having a substantially V-shaped configuration with inwardly projecting apexes; the apex portion of each V-shaped projection being provided with a recess having an indented edge portion for accommodating suspension elements; and further comprising a detachable prop including a projecting part which is shaped to fit into said recess in the apex portion of respective V-shaped projections and to be arrested in a projecting operative position and alternatively, in a collapsed rest position.

* * * * *